United States Patent [19]

Fujita et al.

[11] 4,264,967

[45] Apr. 28, 1981

[54] UNIT TIME PRODUCING SYSTEM

[75] Inventors: Hiro Fujita; Akira Tsuzuki, both of Tokorozawa, Japan

[73] Assignee: Citizen Watch Co., Ltd., Tokyo, Japan

[21] Appl. No.: 85,457

[22] Filed: Oct. 16, 1979

[30] Foreign Application Priority Data

Oct. 20, 1978 [JP] Japan ..... 53-129236

[51] Int. Cl.[3] ..... G04F 5/00; G04B 17/12

[52] U.S. Cl. ..... 368/156; 368/200

[58] Field of Search ..... 331/1 R, 2, 1 A, 14, 331/16, 18, 25, 46–48, 51, 55; 58/23 AC; 368/155–157, 200–203

[56] References Cited

U.S. PATENT DOCUMENTS 3,978,650 9/1976 Hashimoto et al. ..... 368/200

4,024,416 5/1977 Fujita et al. ..... 368/201

4,148,184 4/1979 Akahane et al. ..... 368/202

*Primary Examiner*—Vit W. Miska

*Attorney, Agent, or Firm*—Jordan and Hamburg

[57] ABSTRACT

In an electronic timepiece, a system for producing a unit time signal with a high degree of frequency stability, composed of a low frequency oscillator, a high frequency oscillator of a high degree of frequency stability which is activated only during periodic short intervals, and means for producing a timebase signal which is an exact integral submultiple in frequency of the high frequency oscillator signal, by modifying the output signal from the low frequency oscillator on the basis of periodically recurring phase coincidence between the high and low frequency oscillator signals. Information on this phase variation is stored in digital form, and is utilized to correct the low frequency signal during periods when the high frequency oscillator is inactivated.

16 Claims, 15 Drawing Figures

FREQUENCY DIVIDER 33
8 SEC.
16 SEC.
32 SEC.
112
(A)
4 SEC.
2 SEC.
114
(B)
D
Q
Φ
122
(C)
116
118
124
120
S2
S1
S5
128
(D)
126
S4
S6
130
1 SEC.
1 Hz UNIT
(TIME SIGNAL T.U.)
32
FREQUENCY DIVIDER
(CIRCUIT 84 O/P)
86
L.F.

UNIT TIME PRODUCING SYSTEM

BACKGROUND OF THE INVENTION

At the present time, electronic timepieces are in widespread use, and there is an increasing demand for increased accuracy of timekeeping by such timepieces. At the same time, as electronic wristwatches are made smaller in size, there is a requirement for minimum power consumption, so as to extend the operating lifetime of the timepiece battery as far as possible, or to use a smaller size of battery. One method of achieving high accuracy of timekeeping is to utilized a standard frequency timebase signal source consisting of a quartz crystal oscillator circuit incorporating an AT-cut quartz crystal vibrator operating at a very high frequency, for example of the order of 4 MHz. However, the use of such a high timebase signal frequency brings disadvantages in the form of increased power consumption. The high frequency crystal oscillator circuit itself consumes a significantly greater level of power than a lower frequency oscillator, and also the power consumed by a frequency divider which receives the high frequency signal is substantially increased as compared with the case of a lower frequency of timebase oscillator. The use of a high value of timebase signal frequency provided by a quartz crystal oscillator circuit is therefore not compatible with the requirement for a low level of power consumption, if the conventional method of direct frequency division of the high frequency signal is utilized. For this reason, the timebase signal of an electronic timepiece is generally provided by a quartz crystal oscillator circuit operating at the order of 32 KHz, since reduction of battery power consumption as far as possible is en extremely important consideration in electronic timepiece design.

These disadvantages of the prior art are avoided by the present invention, whereby a relatively low frequency signal of only moderate frequency stability serves to produce a signal which is frequency-processed to provide a timebase signal which is (when averaged over a certain minimum period of time) an exact integral submultiple of the frequency of a high-stability quartz crystal oscillator circuit. Since direct frequency division of the output signal from the high frequency oscillator is not performed, the disadvantages of increased power consumption referred to above are avoided. In addition, the high frequency oscillator is activated only periodically, with a very low duty cycle, so that only a very low level of power is consumed by it.

SUMMARY OF THE INVENTION

The present invention comprises a relatively high frequency oscillator with a high degree of frequency stability, and a relatively low frequency oscillator which need not be of a very high degree of frequency stability. The frequency of the relatively low frequency oscillator is predetermined to have a value f2 which differs by a small amount from an integral submultiple of that of the relatively high frequency oscillator circuit, i.e. f2 differs slightly from f1/N, where N is a positive integer and f1 is the frequency of the relatively high frequency oscillator. The phase of the relatively low frequency signal will therefore vary periodically with respect to that of the relatively high frequency signal, i.e. the relatively high and low frequency signals will periodically coincide in phase. In the present invention, a phase comparator circuit generates a signal whose period is equal to that with which the relatively low and high frequency signals coincide in phase. The phase comparison signal thus derived is used to modify the frequency of the relatively low frequency signal, in a frequency processing circuit, whereby a signal is produced which is aperiodic, but whose frequency when averaged over a certain minimum time interval is an exact integral submultiple of that of the relatively high frequency signal, i.e. whose frequency is f1/N. The latter signal is then utilized as a standard frequency timebase signal, and is frequency divider to produce a unit time signal for use by the timekeeping circuit of the electronic timepiece. The relatively high frequency oscillator is activated only for brief intervals, periodically, in order to reduce power consumption, and the phase comparison process is carried out during these intervals. The results of the phase comparison are stored, as a digital count, and are periodically input to the frequency processing circuit during times when the relatively high frequency oscillator is inactivated. This enables the duty cycle with which the relatively high frequency oscillator is activated to be made very small, for example of the order of one second in every minute.

In this way, a standard frequency timebase signal is produced whose frequency is an integral submultiple of that of the high stability high frequency quartz crystal oscillator, with no significant increase in power consumption as compared with a relatively low frequency quartz crystal standard timebase frequency signal source.

DESCRIPTION OF THE PREFERRED EMBODIMENTS

Figure 1:
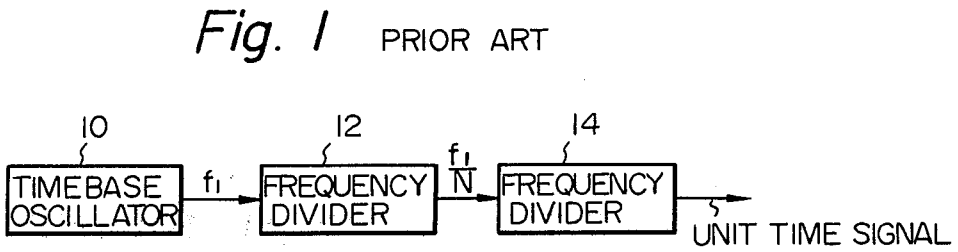
Fig. 1 PRIOR ART
FIG. 1 is a block diagram of a system for producing a unit time signal as used in the prior art.

Referring first to FIG. 1, a conventional type of system for producing a unit time signal in an electronic timepiece is shown, in block diagram form. Reference numeral 10 denotes a quartz crystal oscillator circuit which provides a standard frequency timebase signal. This signal is applied to a first frequency divider 12, to produce a signal having frequency f1/N, where f1 is the frequency of oscillator 10 and N is an integer. This frequency divided signal is then applied to a second frequency divider denoted by reference numeral 14, which thereby produces a standard unit time signal, having a period of one second, for example. Frequency dividers 12 and 14 may constitute a single circuit, however due to the fact that the circuitry which receives the timebase signal from oscillator 10 will usually differ from the circuitry of later frequency division stages which handle lower frequency signals, it is convenient to divide the frequency division process into two separate blocks for the purpose of explanation. The highest degree of frequency stability of a quartz crystal oscillator circuit is provided by a circuit utilizing an AT-cut quartz crystal vibrator operating at a frequency of the order of 4 MHz or higher. However, if such a high frequency of timebase signal is utilized, then the power consumed by the initial stages of frequency divider 12 is made relatively high. In addition, since the timebase oscillator circuit itself is operated continuously, a high level of power is consumed by that oscillator, and for the above reasons, such a high frequency quartz crystal oscillator circuit is not normally utilized in an electronic timepiece, since the power consumption in such a timepiece must be held to the absolute minimum. The standard timebase signal source of a conventional form of electronic timepiece therefore generally comprises a quartz crystal oscillator circuit operating at a frequency of the order of 32 kHz.

Figure 2:
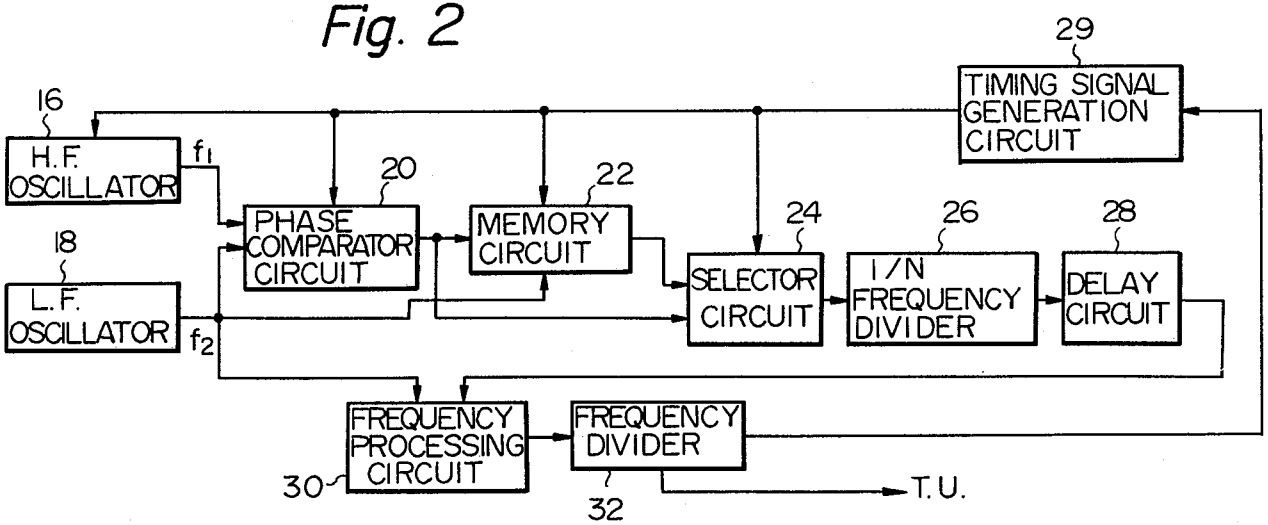
FIG. 2 is a block diagram of a system for producing a unit time signal according to the present invention.

Referring now to FIG. 2, a general block diagram of a system according to the present invention for producing a unit time signal in an electronic timepiece is shown. Reference numeral 16 denotes a relatively high frequency quartz crystal oscillator circuit, comprising for example a circuit utilizing an AT-cut quartz crystal vibrator operating at the order of 4 MHz. Reference numeral 18 denotes a relatively low frequency oscillator circuit which can for example comprise a quartz crystal vibrator circuit operating at a frequency of the order of 32 kHz. The signal produced by the relatively high frequency oscillator circuit will be referred to as the H.F. signal hereinafter, and its frequency denoted as f1, while the signal produced by the relatively low frequency oscillator will be referred to as the L.F. signal, and its frequency will be denoted as f2. The L.F. signal frequency f2 is predetermined to be different from a value f1/N, by a small amount, where N is a positive integer. Numeral 29 denotes a timing signal generating circuit which generates various timing signals, one of which periodically activates and inactivates the operation of H.F. oscillator 16. Numeral 20 denotes a phase comparator circuit which compares the H.F. and L.F. signals, and produces a phase comparison signal, the frequency of which is equal to the frequency with which the H.F. signal and L.F. signal coincide in phase periodically. This phase comparison signal is applied to a memory circuit 22 and to an input of a selectror circuit 24. The L.F. signal is also applied to the memory circuit. Timing signals produced by timing signal generating circuit control the operation of the system such that, during a predetermined interval in which H.F. oscillator 16 is activated, the H.F. signal and L.F. signal are compared in phase, and the resultant phase comparison signal is input to memory circuit 22, to be stored therein as a count value, and is also passed through selector circuit 24, to a 1/N frequency divider denoted by reference numeral 26, where N is the positive integer referred to hereinabove. The frequency-divided output from 1/N frequency divider 26 is passed through a delay circuit 28, which may consist of a low-pass filter (abbreviated hereinafter to LPF), or a latch type of bistable circuit.

It should be noted that it is also possible to utilize the delay circuit 28 at the input to the 1/N frequency divider, rather than its output. The output signal from the 1/N frequency divider 26 and delay circuit 28, which we shall refer to hereinafter as the correction signal, is applied to an input of a frequency processing circuit 30, in which the frequency of the L.F. signal is aperiodically increased or decreased in frequency in accordance with the correction signal, depending upon whether the L.F. signal has been predetermined to be slightly greater than or slightly less than the frequency f1/N. Since aperiodic frequency addition is much easier to implement in practice than frequency subtraction, a value for the L.F. signal which is slightly less than f1/N is utilized in the embodiments of the present invention described hereinafter. This aperiodic frequency addition is facilitated by the action of delay circuit 28. The operation of the circuit of FIG. 2 while the H.F. signal is being generated is illustrated by the block diagram of FIG. 3. Memory circuit 22 is not shown in FIG. 3 but in used during this mode of operation. The output timebase signal from frequency processing circuit 30 is input to a frequency divider 32, which thereby produces a unit time signal, to be utilized by the timekeeping circuit of the timepiece.

During the intervals in which H.F. oscillator 16 is deactivated, the count value which has been stored in memory circuit 22 as described above, is utilized to periodically apply groups of pulses (consisting of L.F. signal pulses, or pulses derived from the LF signal) through the selector circuit 24 to 1/N frequency divider 26. The number of pulses in each of these groups is equal to the number of pulses in the phase comparison signal applied from phase comparator circuit to the 1/N frequency divider 26 while the HF oscillator was activated. After an integral number of such groups of pulses have been generated, the H.F. oscillator 16 is again activated. The process described above is then repeated.

Figure 3:
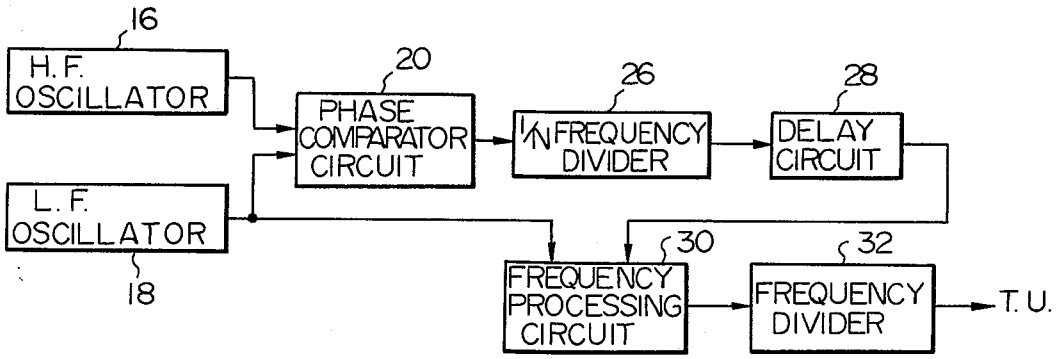
FIG. 3 is an equivalent illustrating the operation of the system of FIG. 2 when the relatively high frequency oscillator is activated.
Figure 4:
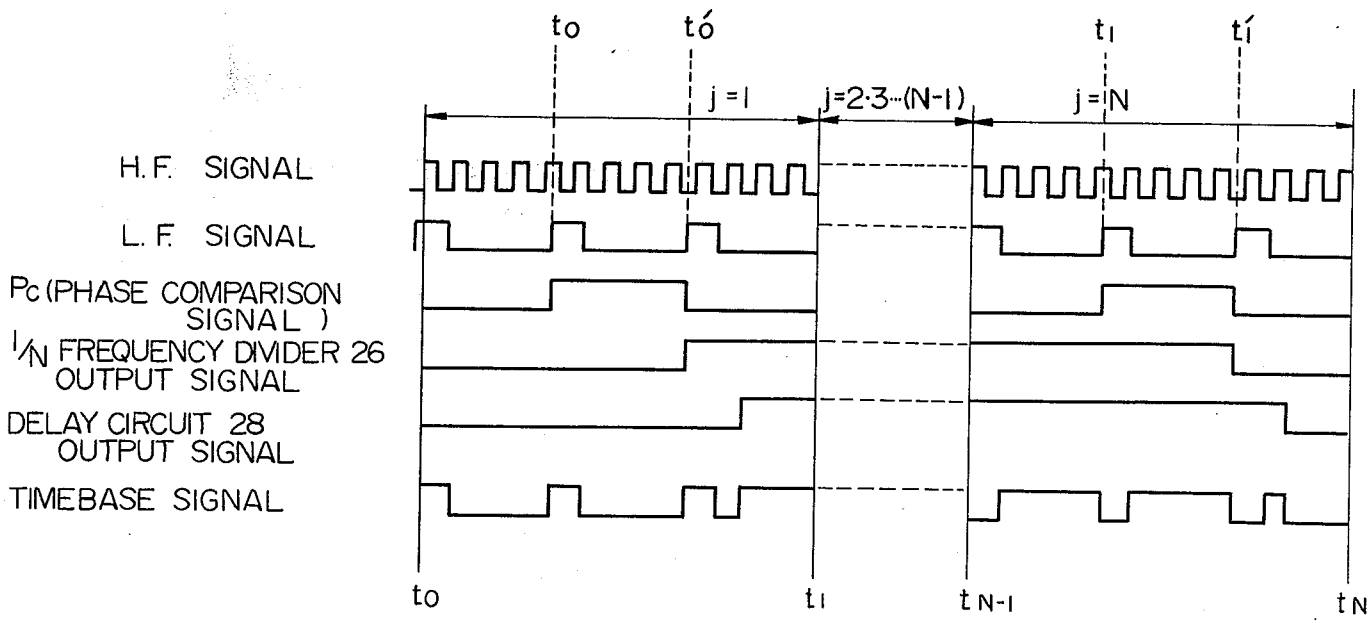
FIG. 4 is a waveform diagram illustrating the operation of the circuit of FIG. 3.

The sequence of operations described above may be more clearly understood in conjunction with the waveform diagram of FIG. 4, which illustrates the operation when the H.F. signal is being produced, i.e. the operating condition shown in FIG. 3.

As stated above, the frequency f2 of the H.F. signal is predetermined to be $f2>f1/N$ or $f2<f1/N$. One period of the L.F. signal therefore corresponds to $(N\pm\alpha)$ periods of the H.F. signal, where $\alpha$ is a real number whose absolute value is less than one. If the L.F. signal and H.F. signal are produced completely independantly on one another, i.e. there is no interaction between them, then the factor $\alpha$ ensures that they will periodically coincide in phase. As shown in FIG. 4, the phase comparator circuit produces a change in logic level of the phase comparator signal (from the L to the H logic level in FIG. 4) each time phase coincidence between the H.F. signal and L.F. signal occurs, or shortly thereafter, at times $t_0$ and $t_1$.

Each period of the L.F. signal corresponds to $(N+\alpha)$ periods of the H.F. signal, where N is the positive integer referred to hereinabove. The number of H.F. signal pulses contained in one period of the phase comparison signal is determined by the value of $\alpha$, the mode of operation of the phase comparator circuit, the frequency stability of the L.F. oscillator, etc.

If we denote the number of L.F. signal pulses contained in one period of the phase comparison signal as n, then the number of H.F. signal pulses contained in one cycle of the phase comparison signal, which we can designate as P, is given by:

$$P=nN\pm 1$$

In the above equation, "+" should be inserted if the fraction $\alpha$ is greater than zero, and "−" should be inserted if the fraction $\alpha$ is less than zero.

Since the LF signal is not completely stable, the values n and P are not constant, and may generally be expressed as:

$$Pi=n_iN\pm 1$$

For j consecutive periods of the phase comparison signal, the following equalities hold true:

$$\sum_{j=1}^{j} pi = \sum_{j=1}^{j} (n_iN \pm 1) = \sum_{j=1}^{j} n_iN \pm j$$

If j=N, then $$\sum_{j=1}^{N} pi = N\left(\sum_{j=1}^{N} n_i \pm 1\right)$$

i.e.

$$\sum_{j=1}^{N} Pi/N = \sum_{j=1}^{N} n_i \pm 1$$

The left hand side of the above equation is a value which is obtained by dividing the number of H.F. pulses contained in a certain time interval by the factor N. The right hand side represents a value which is obtained by adding or subtracting one pulse from the total number of pulses occurring in the time interval referred to above.

In the case of the example of FIG. 4, the phase comparison signal goes from the high logic level (referred to herein as the H logic level) to the low logic level at time $t_0'$, after time $t_0$, whereupon the output of the 1/N frequency divider 26 goes from the L to the H logic level. After N periods of the phase comparison signal, the output signal of the 1/N frequency divider 26 returns from the H to the L logic level. The output from delay circuit 28 is delayed with respect to the output from 1/N frequency divider 26, as shown, enabling aperiodic frequency addition of the 1/N frequency divided phase comparison signal to be accomplished by frequency processing circuit 30, thereby providing the timebase signal. In this case, since frequency addition is performed by frequency processing circuit 30, the factor $\alpha$ must be made greater than zero.

Figure 5:
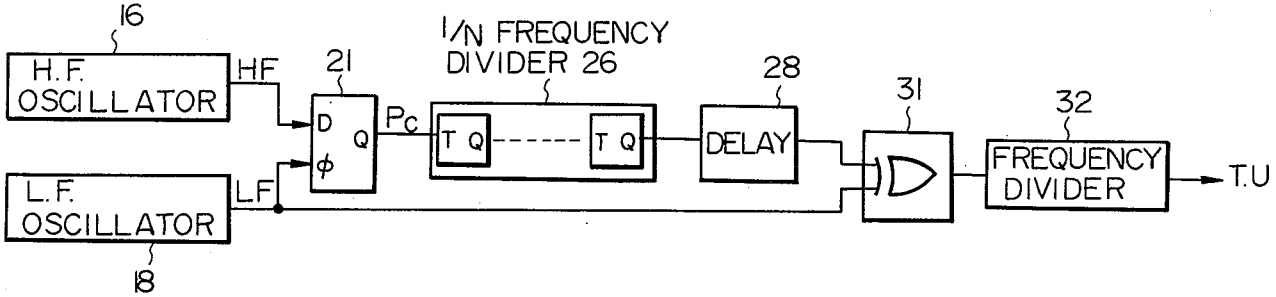
FIG. 5 is a block diagram for illustrating one example of a concrete circuit arrangement comprising a phase comparator circuit and a frequency processing circuit as shown in FIGS. 2 and 3.

A specific arrangement of circuit blocks for producing the signals shown in FIG. 4 is given in FIG. 5. Here, phase comparator circuit comprises a data-type flip-flop (referred to hereinafter as F/F) 21, and frequency processing circuit is composed of an exclusive-OR gate designated as 31. The 1/N frequency divider 26 is composed of a series of cascaded toggle-type flip-flops. Such a circuit arrangement is advantageous, in that it is only necessary for the data-type F/F to operate at high speed.

It should be noted that a timebase signal generating system such as that of FIG. 5 is fundamentally different from a phase-locked loop type of circuit. The system of the present invention is essentially an open-loop type of control system, and utilizes digital control, as compared with a phase-locked loop type of circuit utilizing closed-loop, analog singal control. An open-loop type of control system such as that of the present invention is much more suited to mass-production integrated circuit manufacturing techniques than is a phase-locked loop system, since component values can be determined such that no setting-up or other adjustment is necessary before the system is put into use.

The degree of frequency stability required for the L.F. signal will now be considered. Designating one period of the H.F. signal as To, which is equal to 1/f1, and designating one period of the L.F. signal as T1, equal to 1/f2, then:

$$T1\pm\Delta T1=(N+\alpha+\Delta\alpha)To$$

In order for the value of N to be held constant, it is necessary that the absolute value $|\alpha+\Delta\alpha|$ should not exceed one.

With regard to one period of the phase comparison signal, the following relationships must hold:

$$n\Delta T1<To$$

$$\frac{\Delta T1}{T1} < \frac{1}{n(N+\alpha)} \div \frac{1}{nN}$$

From the above, it can be seen that the degree of frequency stability required of the L.F. signal is determined by the value of the division ratio N and that of the factor $\alpha$.

It is possible to utilize the method shown in FIG. 5 and described hereinabove to obtain an aperiodic timebase siganl whose frequency, averaged over a certain minimum time interval, is an integral submultiple of that of the H.F. signal. Hence, highly accurate unit time signal can be obtained. However it is also possible, as will be made clear by the following embodiment of the present invention, to activate the H.F. oscillator 16 only periodically for short time intervals, and to store phase comparison information obtained during these time intervals in a memory circuit. Between these time intervals, the phase comparison information stored in the memory can be used in periodically generating a correction signal to be applied to the frequency processing circuit. If the L.F. oscillator is stable in frequency during the time intervals in which the H.F. signal is inactivated, an identical frequency stability to that obtainable with the H.F. oscillator operated continuously can be obtained, even when the duty cycle for operation of the H.F. oscillator is very low.

Figure 6:
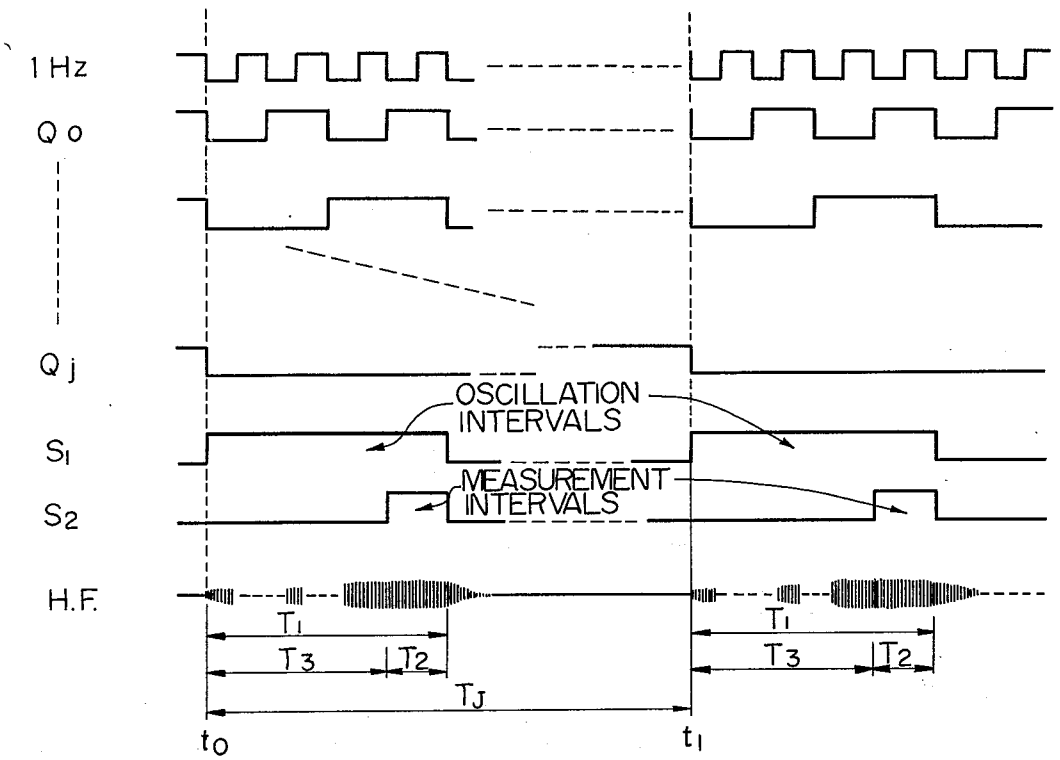
FIG. 6 is a waveform diagram illustrating the process by which the relatively high frequency oscillator is periodically activated.

FIG. 6 is a waveform diagram illustrating the signals by which the H.F. oscillator is made to operate periodically. The signal denoted as 1 Hz is produced by frequency divider circuit 32 in FIG. 2, and is input to the timing signal generating circuit 29.

Timing signal generating circuit 29 includes a frequency divider having j stages, the output of the first stage of this frequency divider being indicated as Qo in FIG. 6 and the output of the jth stage being designated as Qj. The frequency with which the H.F. oscillator circuit is activated is determined by the period of signal Qj, which is used to generate a control signal S1, which defines consecutive time intervals of duration T1, during which the H.F. oscillator circuit is activated. These time intervals will be referred to hereinafter as oscillation intervals. The period of the Qj signal is designated as Tj, and the duty cycle for which the H.F. oscillator circuit is activated, and hence the level of power consumed by the H.F. oscillator circuit, is determined by the ratio T1/Tj. When signal S1 is at the L logic level, the H.F. oscillator circuit is deactivated.

A signal S2 is also generated with the same period as signal Qj. When signal S2 is at the H logic level, time intervals designated as T2 are defined during which phase comparison of the L.F. signal and H.F. signal is performed. The latter time intervals will be referred to hereinafter as measurement intervals. The time T3 which represents the difference between time intervals T1 and T2 is a period during which the frequency of the H.F. signal stabilizes. The waveform of the H.F. signal is indicated as H.F., at the lower part of FIG. 6.

Typical values for the time intervals T3, T2 and Tj are 3 seconds, 1 second and one minute, respectively. However the values actually selected will depend upon factors such as the ambient operating temperature, the frequencies and stability of the HF, and L.F. oscillators, etc. These time values may be kept constant, or can be made to vary in accordance with variable factors such as ambient operating temperature, acceleration, etc.

The duration of time interval T2, during which the phase comparator circuit 20 is operative will determine the number of bits of digital information which must be stored in the memory circuit 22. For example, if the frequencies of the H.F. signal and L.F. signal, f1 and f2, are 4 MHz and 32 kHz respectively, and the ratio f1/f2 is set to about 128.25, then the frequency of the phase comparison signal will be about 8 kHz. If the duration of each time interval in which the phase comparator is operative is 1 second (i.e. T2 is one second), then the memory circuit 22 must contain 13 or 14 bits of storage capacity.

Figure 7:
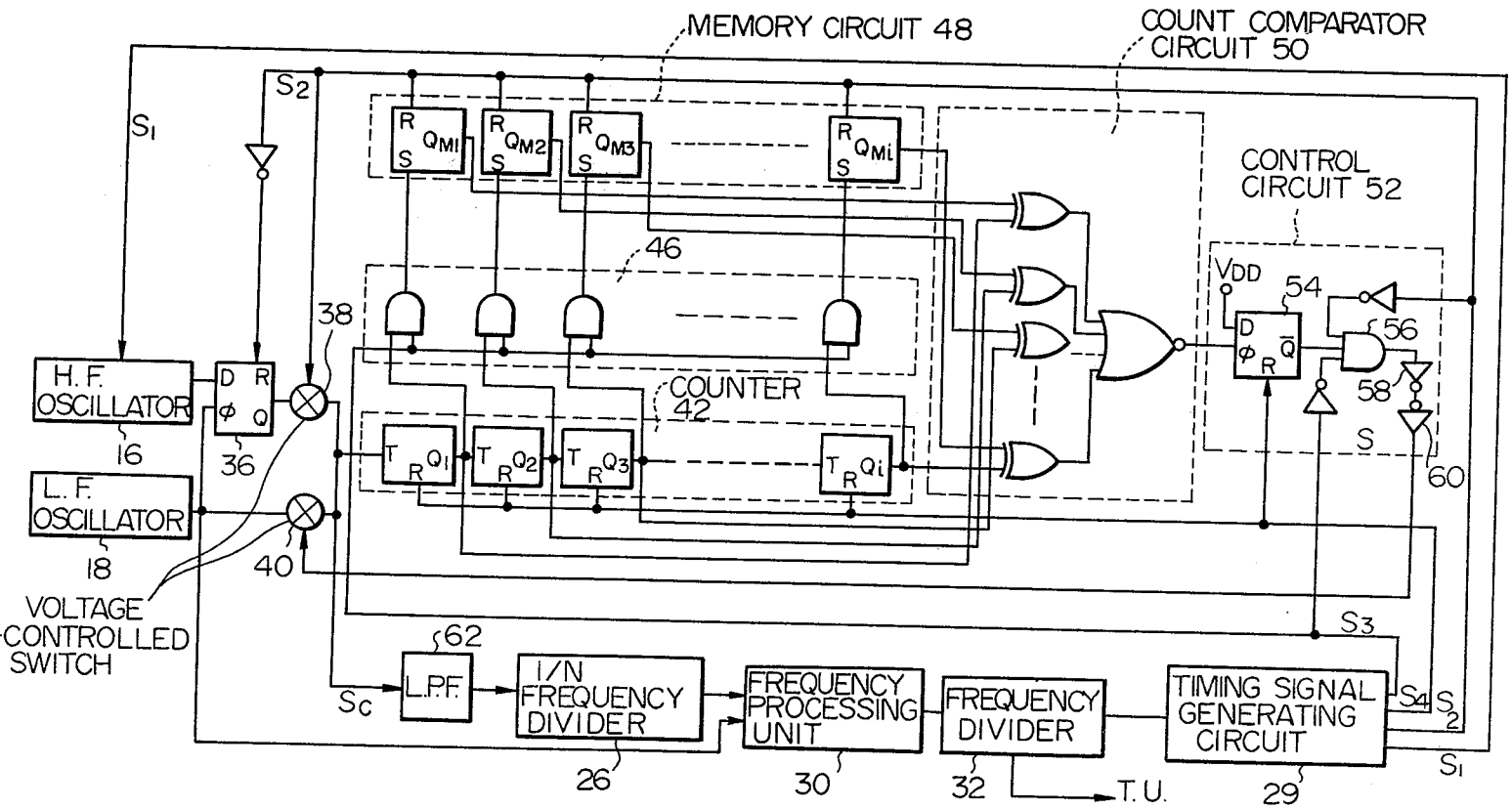
FIG. 7 is a block circuit diagram of a first embodiment of the present invention in which the relatively high frequency oscillator is periodically activated.
Figure 8:
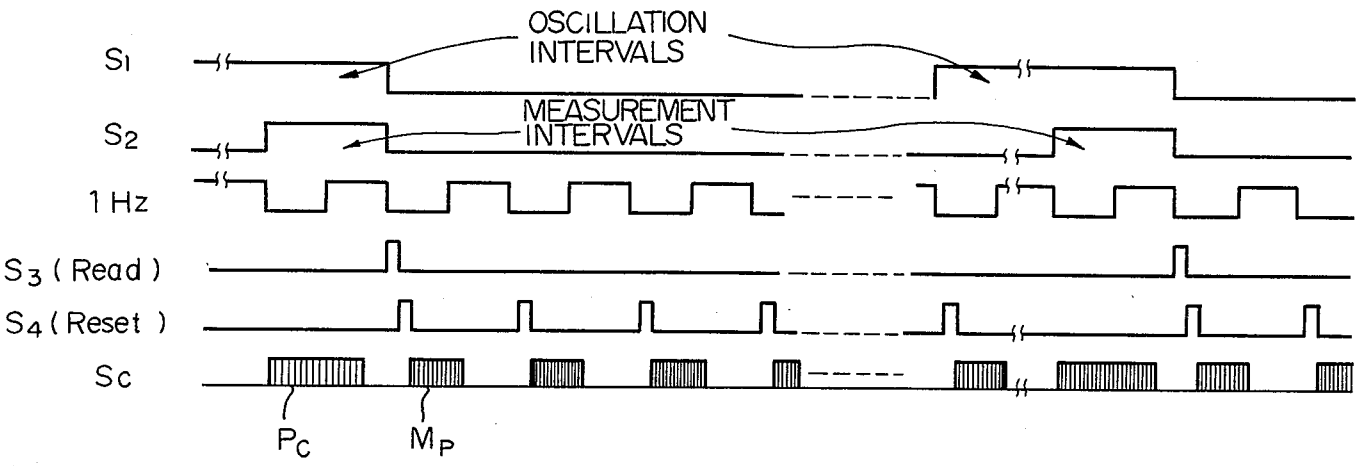
FIG. 8 is a waveform diagram illustrating the operation of the circuit of FIG. 7.

A first embodiment of a system for producing a unit time signal in accordance with the present invention is shown in FIG. 7. Waveforms to assist in explaining the operation of the circuit of FIG. 7 are shown in FIG. 8. In FIG. 7, reference numerals having the same values as in FIG. 2 and FIG. 3 indicate circuit blocks having similar functions to those described hereinabove for these blocks. Numeral 36 denotes a data-type flip-flop which performs the function of phase comparator circuit 20, as will be described. Memory circuit 48, AND gate circuit 46, and frequency divider circuit 42, together with a count comparator circuit 50, collectively correspond to the memory circuit block 22 of FIG. 2, voltage-controlled switches 38 and 40 together correspond to the selector circuit 24 of FIG. 2. Timing sigal generating circuit 29 produces control signals S1, S2, S3 and S4, as shown in FIG. 8. A control circuit 52 controls the operation of voltage-controlled switch 40.

The operation of the circuit of FIG. 7 will now be described. Signal S1, applied from timing signal generating circuit 29 to H.F. oscillator circuit 16 enables H.F. oscillator circuit 16 to operate during periodic oscillation intervals. Signal S2 from timing signal generating circuit 29 is applied in inverted form to data-type flip-flop 36 reset terminal. Thus, when signal S2 is at the L logic level, data-type flip-flop 36 is held in the reset state. During periodic measurement intervals, when the S2 signal is at the H logic level, a phase comparison signal is output by data-type flip-flop 36, and applied to voltage-controlled switch 38. The H.F. signal from H.F. oscillator circuit 16 is applied to the data terminal of data-type flip-flop 36, while the L.F. signal is applied to the clock terminal thereof. The L.F. signal from L.F. oscillator 18 is also applied to voltage-controlled switch 40, and to frequency processing circuit 30. Counter 42, which is coupled to receive the phase comparison signal or L.F. signal transferred by voltage-controlled switch 38 and voltage-controlled switch 40 respectively, comprises a series of cascaded toggle-type filp-flops constituting i stages. Memory circuit 48 comprises a set of i set/reset flip-flops, having their set terminals coupled to corresponding outputs of AND gate circuit 46, as shown, and with each flip-flop's reset terminal being coupled to receive the S2 control signal. One terminal of each gate in AND gate circuit 46 is coupled to receive control signal S3, with the other input terminal of each AND gate being connected to the Q output of a corresponding one of the flip-flops of counter 42. The outputs of frequency divider 42 and of memory circuit 48 are input to a count comparison circuit 50, in which the contents of each are compared. When coincidence between the contents of memory circuit 48 and counter 42 is detected, then the output of count comparator circuit 50 goes from the L to the H logic level. As a result, the Q output of a data-type flip-flop 54 in a control circuit 52 goes from the H to the L logic level, since the data input terminal of F/F 54 is connected to the H logic level.

At the start of an oscillation interval, the H.F. oscillator circuit 16 becomes activated, as described previously. When the oscillation frequency has become stabilized, then a measurement interval begins, with S2 control signal going to the H logic level. A phase comparison signal, the frequency of which is identical to the frequency with which the H.F. and L.F. signals periodically coincide in phase, is thereby produced by data-type flip-flop 36, and is passed through voltage-controlled switch 38, which is now enabled by signal S2. This phase comparison signal is thereby input to counter circuit 42, and is counted therein. The phase comparison signal is also passed through a low-pass filter 62, which serves as a delay element, corresponding to delay circuit 28 of FIG. 2, to 1/N frequency divider 26, which thereby produces a correction signal. The correction signal is applied to frequency processing circuit 30, together with the L.F. signal. Frequency processing circuit 30 periodically adds the frequency of the phase comparison signal to that of the L.F. signal, as shown in FIG. 4 above. The output signal from voltage-controlled switches 38 and 40 is designated as Sc in FIGS. 7, and 8, and the pulse train comprising the phase comparison signal during a measurement interval is designated as Pc in FIG. 8.

At the end of a measurement interval, the number of phase comparison pulses Pc which have been generated during that measurement interval are stored in counter 42 as a count value. Shortly after, a read control signal S3 is generated by timing signal generating circuit 29 and causes the count value stored in counter 42 to be read through AND gate circuit 46 into memory circuit 48, in which this count value is stored. After control signal S3, a control signal S4 is generated by timing signal generating circuit 29. Signal S4 resets the contents of counter 42 to zero, and also resets the data-type flip-flop 54 in control circuit 52. The $\overline{Q}$ output of data-type flip-flop 54 therefore goes to the H logic level at this time. Signals S3 and S2, which are at the L logic level at this time, are applied in inverted from to inputs of an AND gate 56, together with the $\overline{Q}$ output of FF 54. The output of AND gate 56 therefore goes to the H logic level when FF 54 is reset, causing the voltage-controlled switch 40 to be enabled by the output from an inverter 60 in control circuit 52. The L.F. signal is therefore passed by voltage-controlled switch 40 to the input of counter 42, which begins to count the L.F. signal pulses. The pulses which are passed by voltage-controlled switch 40 at this time are designated as Mp in FIG. 8. The count in counter 42 is compared with the contents of memory circuit 48 by the count comparator circuit 50, and when this count is detected as being equal to the contents of memory circuit 48, then the output of the count comparator circuit 50 goes from the L to the H logic level, thereby causing the $\overline{Q}$ output of FF 54 to go to the L logic level. AND gate 56 is thereby inhibited, so that the output of inverter 60 goes to the L logic level, thereby inhibiting voltage-controlled switch 40. Thus, when the number of L.F. signal pulses counted by counter 42 is detected as being equal to the count value which is stored in memory circuit 48, further transducer of L.F. signals pulses through voltage-controlled switch 40 is inhibited. In this way, a number of L.F. signal pulses Mp which is equal to the number of phase comparison signal pulses generated during the preceding measurement interval is applied to low-pass filter 62, and hence to 1/N frequency divider 26. Thus, frequency addition of the group of pulses Mp to the L.F. signal by frequency processing unit 30 is performed in the same way as frequency addition of the phase comparison pulses Pc was performed during the previous measurement interval. In other words, frequency correction of the L.F. signal in frequency processing unit 30 is performed after each of the read control pulse S3 and reset pulse S4 pulse pairs, in the same way as if each of these pairs of pulses were followed by a measurement interval. Thus, even if the frequency stability of the L.F. oscillator circuit 18 is not sufficiently high that the L.F. signal can be utilized during the periods between successive measurement intervals without correction, the method of the present invention enables the frequency correction process to be carried out by frequency processing unit 30 at short periodic intervals between each successive pair of measurement intervals. In this way, a timebase signal of high frequency stability can be produced by frequency processing unit 30 in spite of the fact that the H.F. oscillator 16 is only activated with a very low duty cycle, i.e. during each of the oscillation intervals, with a long interval of deactivation being provided between successive oscillation intervals. This is made possible by utilizing the count value stored in memory circuit 48. The duration of a measurement interval can be made one second, for example, and the period between successive groups of pulses Mp can be one minute. Thus, if we call the time period during which the groups of pulses Mp are successively generated the self-timing mode, it can be seen that the duration of the self-timing mode can be made considerably longer than the duration of an oscillation interval, in other words the duty cycle with which the H.F. oscillator 16 is activated can be made very low.

In this way, although the H.F. oscillator circuit is activated only periodically for short intervals, an accuracy of timebase signal frequency is obtainable which is comparable to that obtained if the H.F. oscillator were maintained in continuous operation. It will therefore be appreciated that the present invention results in a reduction of the power consumed by the H.F. oscillator circuit 16 to a very low level, while providing a timebase signal which is stabilized frequency to an integral submultiple of the H.F. signal frequency.

It should be noted that the application of control pulses S3 and S4 to AND gate 56 in inverted form serves to ensure that, even if the $\overline{Q}$ output of FF 54 goes to the H logic level during an S3 or S4 control pulse, voltage-controlled switch 40 will not be enabled thereby.

Figure 9:
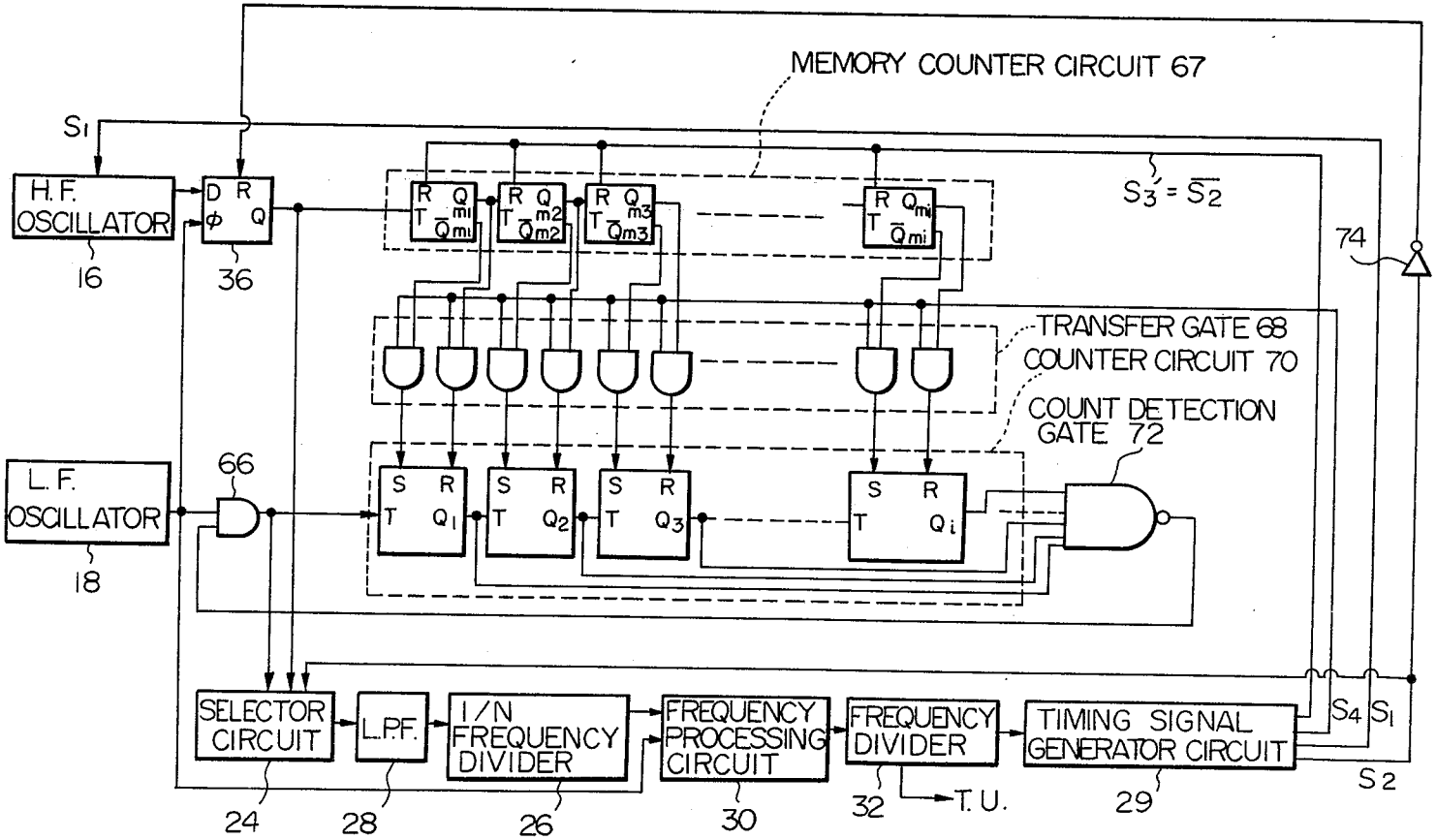
FIG. 9 is a block circuit diagram of a second embodiment of the present invention.

Referring now to FIG. 9, a second embodiment of the present invention will be described. The waveform diagram of FIG. 8 is also applicable to the embodiment of FIG. 9. In FIG. 9, numeral 67 denotes a memory counter circuit, which counts a number of phase comparison signal pulses output from a phase comparator flip-flop 36, which is a data-type flip-flop as in the embodiment FIG. 7. Immediately prior to the start of each measurement interval, a timing control signal pulse S3′ equal to $\overline{S2}$ is applied to the reset terminals of memory counter 67, resetting the contents therein to zero. Control signal S2 is applied in inverted form to the reset terminal of data-type FF 36. At the end of a measurement interval, a count value is stored in memory counter 67 which corresponds to the number of phase comparison signal pulses generated during that measurement interval. The S2 signal then goes from the H to the L logic level, thereby terminating the measurement interval. The signal S4 now goes to the H logic level, causing the complement of the contents of the memory counter circuit 67 to be read into the counter circuit 70 by AND gate circuit 68. This causes the output of a count detection NAND gate 72, which receives the Q output of each stage of counter circuit 70, to go to the H logic level. An input gate, AND gate 66, is thereby enabled to pass L.F. signal pulses to the input of counter circuit 70, to be added to the previously stored contents therein. Thus, when a number of L.F. signal pulses equal in number to the phase comparison pulses generated in the preceding measurement interval is input to counter circuit 70, then all of the Q outputs of counter circuit 70 will attain the H logic level, so that the output of count detection gate 72 will go to the L logic level. AND gate 66 is thereby inhibited from passing further L.F. signal pulses to counter circuit 70. The output of AND gate 66 is connected to low-pass filter 28, and hence to 1/N frequency divider 26, through the selector circuit 24, by the action of control signal S2 upon selector circuit 24, during each self-timing interval. Thus, a group of pulses Mp is applied to frequency processing circuit 30 after each S4 control pulse, as in the case of the first embodiment of the present invention. The same effects as those described above for the first embodiment are therefore obtained, although the method whereby the pulses Mp are generated is different.

Figure 10:
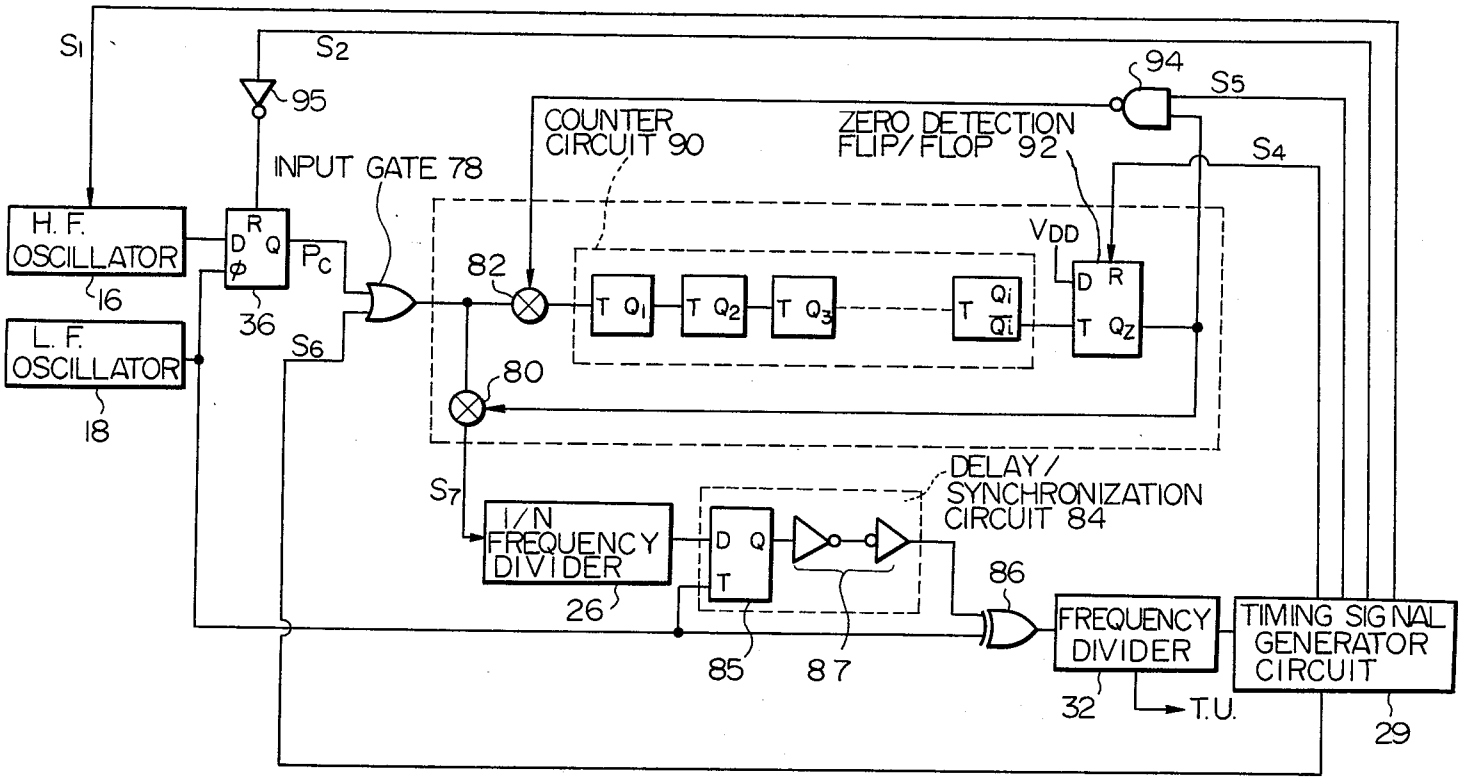
FIG. 10 is a block circuit diagram of a third embodiment of the present invention.

A third embodiment of the present invention will now be described, with reference to FIG. 10 and the waveform diagram of FIG. 11. In FIG. 10, a counter circuit 90 performs both a memory and a counting function, and is comprised of a set of i cascaded toggle-type flip-flops. A zero detection circuit 92 is composed of a data-type flip-flop. A selector circuit is comprised by voltage-controlled switches 80 and 82, which receive a phase comparison signal from a data-type flip-flop 36 and a read pulse signal S6 from the output of an OR gate 78. The output of the zero detection flip-flop 92, designed as detection signal Qz, is applied to one input of an output gate, NAND gate 94. A control signal S5 is applied to the other input of NAND gate 94. The output of NAND gate 94 controls voltage-controlled switch 82, while sthe Qz signal controls the voltage-controlled switch 80.

Numeral 84 denotes a delay/synchronization circuit block, which performs the delay function of the delay circuit 28 of FIG. 2, and ensures accurate frequency addition of a correction signal to the L.F. signal in an exclusive-OR gate 86 which serves as a frequency processing circuit. Timing signal generating circuit 29 produces control signals, S1, S2, S4, S5 and S6, having the timing relationships shown in FIG. 11.

The operation of this embodiment will now be described. At the start of each measurement interval, the contents of counter circuit 90 have been reset to zero, and the output Qz of zero detection flip-flop 92 is the H logic level. During a measurement interval, since the H.F. oscillator 16 is activated by signal S1 and the data-type flip-flop 36 is enabled by the inverted S2 signal, phase comparison pulses are produced by data-type flip-flop 36 andd are passed through OR gate 78 to be applied to the inputs of voltage-controlled switches 80 and 82. At this time, both of voltage-controlled switch 80 and 92 are enabled, since signal Qz and the output of NAND gate 94 are both at the H logic level. The phase correction signal pulses, which are designated as Pc in FIG. 11, are transferred through voltage-controlled switch 82 to the input of counter circuit 90, and through voltage-controlled switch 80 to 1/N frequency divider 26. At the end of the measurement interval, the duration of which is designated as Tm in FIG. 11, signals S1 and S2 return to the L logic level, so that no further phase comparison pulses are output by data-type flip-flop 36. At this point, a count value corresponding to the number of phase comparison pulses applied to the 1/N frequency divider 26 during the preceding measurement period is stored in counter circuit 90. A reset signal S4 now goes to the logic level, thereby causing signal Qz from FF 92 to go to the L logic level. Voltage-controlled switch 80 is thereby inhibited, and remains in that state after signal S4 returns to the L logic level. At this time, timing signal generating circuit 29 begins to generate a group of pulses as signal S6, this group being designated by the numeral 84 in FIG. 11. Voltage-controlled switch 82 is now enabled, since the output of NAND gate 94 is at the H logic level, so that these S6 signals pulses pass through OR gate 78 and voltage-controlled switch 82 to the input of counter circuit 90. The total number of pulses in each group of pulses of signal S6 is $2^i$. The count in counter circuit 90 now begins to increase. When the maximum count is attained, output $\overline{Q}i$ of the final stages of counter 90 goes to the L logic level. When the next pulse is applied to the input terminal of the first stage of counter 90, the $\overline{Q}i$ of the final stage of counter 90 goes to the H level, thereby causing the Qz output of data-type flip-flop 92 to go to the H logic level, since the data terminal is connected to the H logic level. The voltage-controlled switch 80 is therefore now enabled, so that the remaining pulses of S6 signal pulse group 84 are passed to the input of 1/N frequency divider 26. Since signal S5 is at the L level, voltage-controlled switch 82 remains in an enabled state, so that the S6 pulses continue to be input to the counter circuit 90. Thus, at the termination of the S6 pulse group 84, a number of pulses equal in number to that stored in counter circuit 90 at the start of pulse group 84 will have been transferred to the input of 1/N frequency divider 26. Also, since the number of pulses in pulse group 84 of the S6 signal is dependent on the value determined by the number of stages in counter circuit 90, i.e. $2^i$, the count remaining in counter circuit 90 at the end of pulse group 84 will be identical to the count which was stored therein at the commencement of pulse group 84. Thus, the number of pulses input to 1/N frequency divider 26 during S6 signal pulse group 84, designated as Mc in FIG. 11, is identical to the number of phase comparison pulses generated during the preceding measurement interval, designated as Pc.

Figure 11:
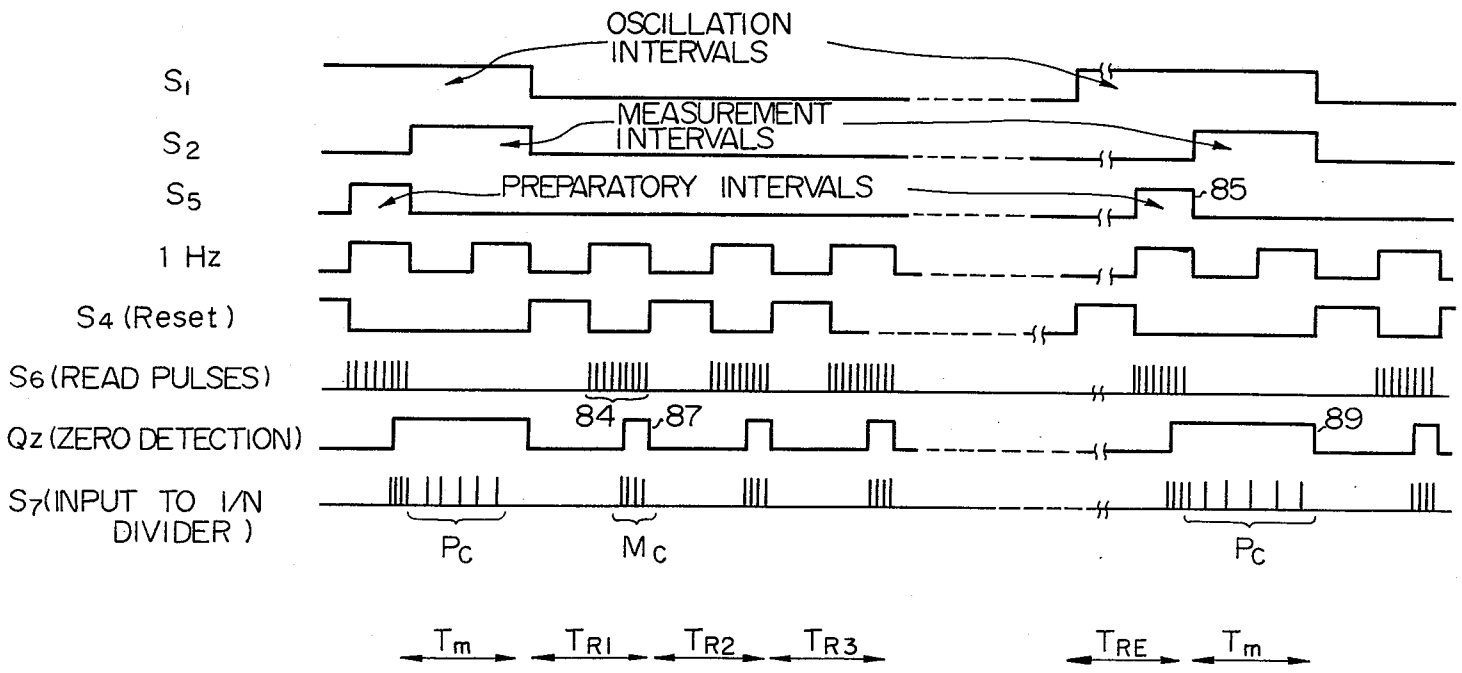
FIG. 11 is a waveform diagram illustrating the operation of the circuit of FIG. 10.

The process described above is repeated for a number of succesive groups of S6 signal pulses, so that correction of the frequency of the L.F. signal by frequency addition in the exclusive-OR gate 86 is successively performed, in time intervals TR1, TR2, TR3, etc., shown in FIG. 11.

During the time intervals TRE which precedes a measurement interval, the operation of the circuit is slightly different. First, as in the case of preceding time intervals Tr1, Tr2, etc., a reset pulse S4 is applied to data-type flip-flop 92, causing signal Qz to go to the L level. A measurement preparation signal S5 then goes to the H logic level, as indicated by numeral 85 in FIG. 11. Read pulses S6 are input to counter circuit 90 through voltage-controlled switch 82, until the maximum count of counter 90 is attained, whereupon all of the outputs Q1 to Qi of counter 90 go to the H logic level. In this instance, the $\overline{Q}i$ of the final stage of counter 90 is at the L level. In this case, if the next pulse is applied to the input terminal of the first stage of counter 90, the $\overline{Q}i$ of the final stage of counter 90 goes to the H level. The Qz output of data-type flip-flop 92 therefore goes to the H logic level, causing the output of NAND gate 94 to go to the L level, so that voltage-controlled switch 82 is inhibited, and the "all zero" condition of the contents of counter 90 is maintained. The H level condition of signal Qz enables voltage-controlled switch 80, so that the remained of the current group of S6 read pulses is passed through voltage-controlled switch 80 to th 1/N frequency divider 26.

Thus, at the start of the next measurement period, the contents of counter circuit 90 are in the "all zero" state and signal Qz is at the H logic level. This condition of the Qz signal is continued throughout the subsequent measurement period, as indicated by numeral 89 in FIG. 11, so that the phase comparison pulses from data-type flip-flop 36 are input to both counter circuit 90 and 1/N frequency divider 26. In this way, measurement intervals and self-timing intervals between the measurement intervals are alternately repeated.

It will be appreciated that the third embodiment of FIG. 10 provides a significant simplification of the memory circuit requirements of the present invention.

The delay/synchronization circuit 84 of the third embodiment serves to synchronize the timing of logic level transitions of the output signal from 1/N frequency divider 26 with the L.F. signal, and then to delay the resultant signal by a predetermined amount with respect to the L.F. signal, to ensure accurate and reliable aperiodic frequency addition by means of exclusive-OR gate 86. Delay/synchronization circuit 84 comprises a data-type flip-flop 85, and a pair of series-connected inverters 87, connected to the Q output of FF 85. The output of divider 26 is applied to the data terminal of FF 85, and the L.F. signal is applied to the toggle input terminal T.

Delay/synchronization circuit 84 ensures that a correction signal is provided to exclusive-OR gate 86 (which functions as a frequency processing circuit) that cannot change in logic level simultaneously with a logic level transition of the L.F. signal. Completely reliable aperiodic frequency addition by exclusive-OR gate 86 is thereby ensured. The timebase signal which is thus provided by exclusive-OR gate 86 is applied to a frequency divider circuit 32, which thereby generates an accurate unit time signal T.U. Frequency divider 32 also generates a clock signal, designated as "1 Hz" in FIG. 11, applied to timing signal generating circuit 29, whereby the various timing signals S1 to S6 are generated by timing signal generating circuit 29.

Figure 12:
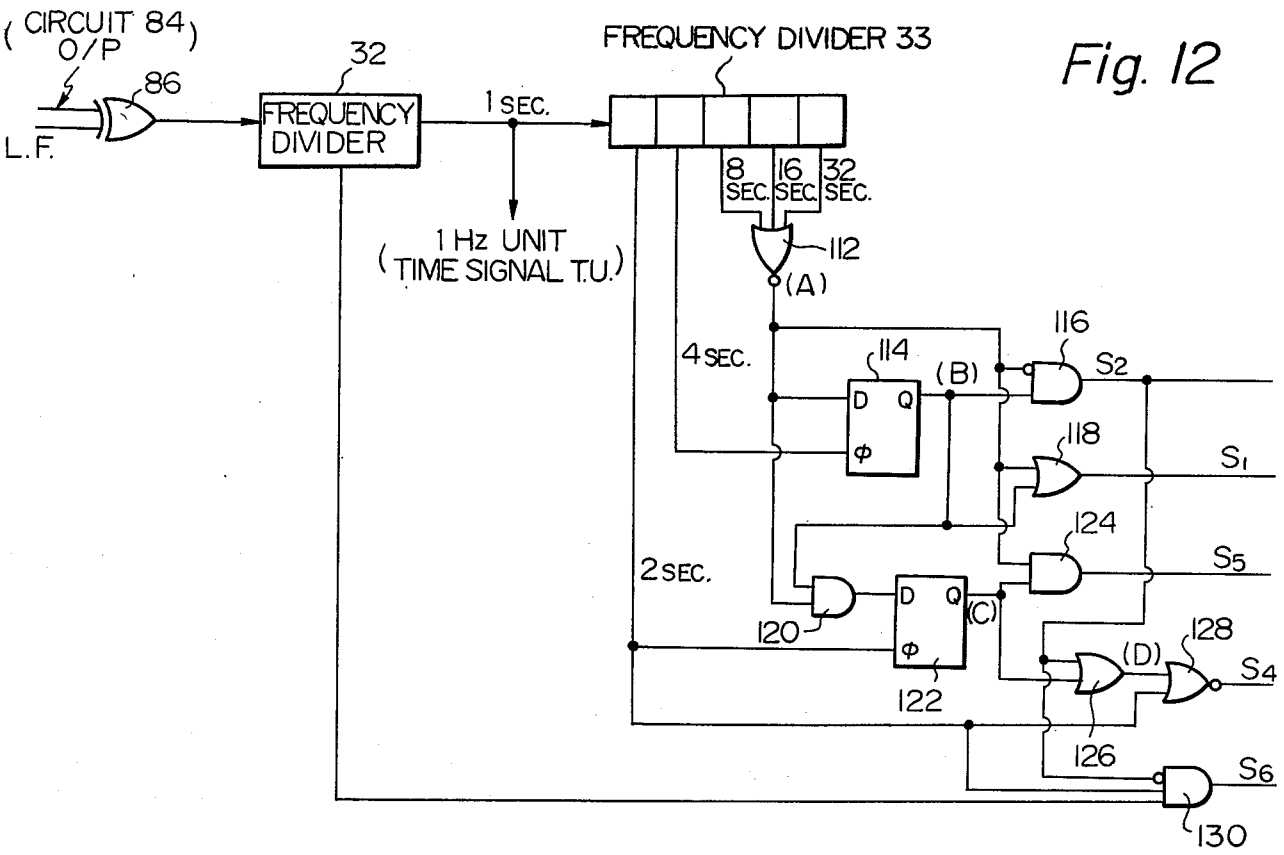
FIG. 12 is a circuit diagram of a timing signal generating circuit suitable for the embodiment of FIG. 10.
Figure 13:
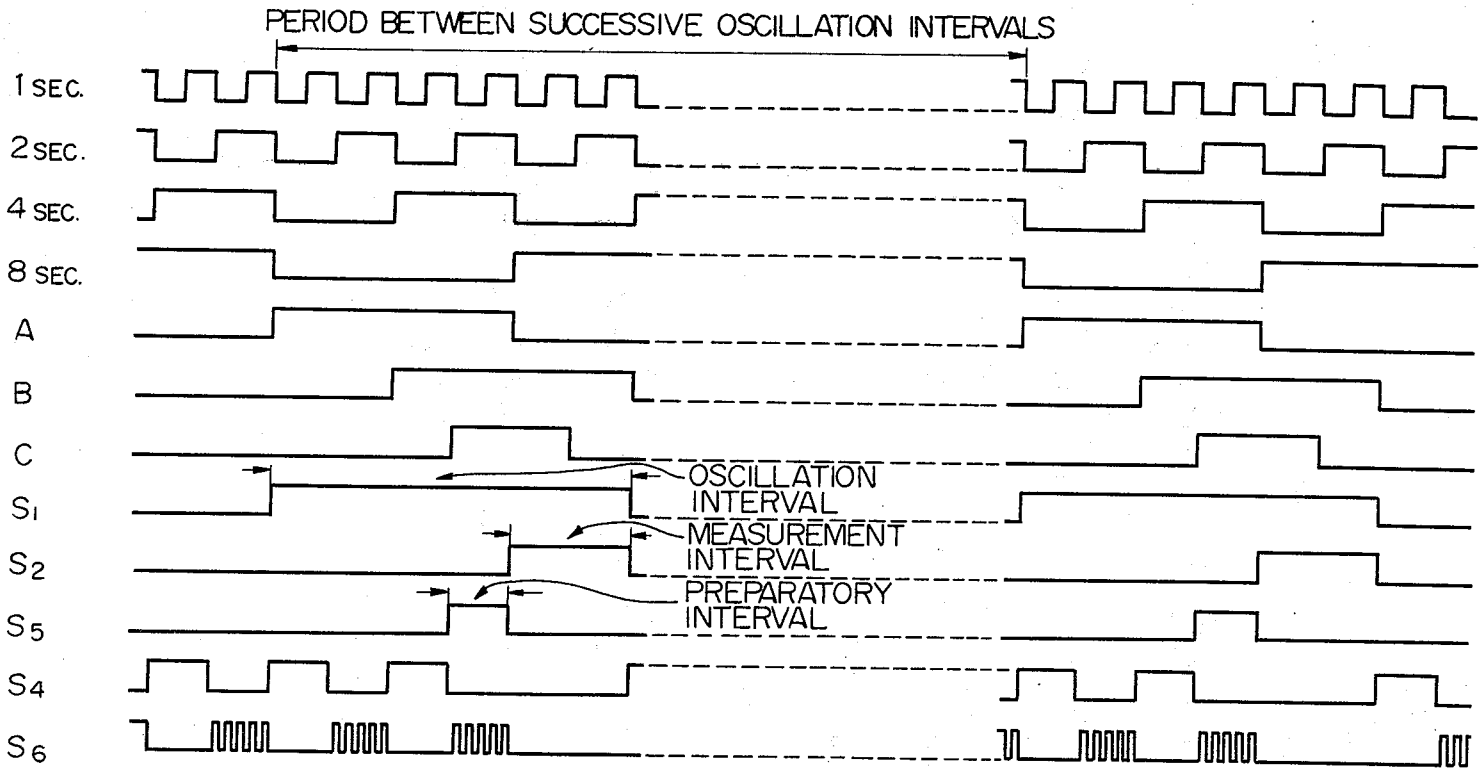
FIG. 13 is a waveform diagram illustrating the operation of the circuit of FIG. 12.

A specific embodiment of the timing signal generating circuit 29 of FIG. 10 will now be described, with reference to the circuit diagram of FIG. 12 and the corresponding waveform diagram of FIG. 13. As shown in FIG. 12, a timing signal having a period of one second, designated as 1 Sec., is input to a frequency divider circuit 33. This 1 Sec. signal can consist of the unit time signal produced by frequency divider 32. Frequency divider 33 thereby produces a group of signals having periods of from 2 to 32 seconds, designated as 2 Sec., 4 Sec., 16 Sec., respectively. The 8Sec., 16 Sec., and 32 Sec. signals are input to NOR gate 112, which thereby produces a signal designated as A, with a period of 32 seconds and the waveform shown in FIG. 13. Signal A is applied to an inverting input of an AND gate 116, to the data terminal of a data type flip-flop 114 and an input of AND gate 120. The 4 Sec. signal from divider 33 is applied to the clock terminal of data type flip-flop 114. In response, data type flip-flop 114 produces a signal B, which is applied to an input of AND gate 116. Timing control signal S2 is thereby produced by AND gate 116. Signal B from data type FF 114 is also input to one input of OR gate 118 together with signal A from NOR gate 112. Timing control signal S1 is thereby produced by OR gate 118. Signal B is also input to AND gate 120, the output of which is coupled to the data terminal of a data-type flip-flop 122. The output of data-type flip-flop 122, signal C, is applied to inputs of AND gate 124, and an OR gate 126. The output of OR gate 126 is applied, together with the 2 Sec. signal, to input of a NOR gate 128. Timing control signal S4 is thereby produced by NOR gate 128. Signal S2 from AND gate 116, the 2 Sec. signal, and the output signal from exclusive-OR gate 86, are input to an AND gate 130, with signal S2 being applied through an inverting input. Timing control signal S6 is thereby produced by gate 130.

With the embodiment of FIG. 12, the period between successive oscillation intervals has a duration of 32 seconds, while the duration of an oscillation intervale (when S1 is at the H logic level) is 6 seconds, and the duration of a measurement interval (when signal S2 is at the H logic level) is 2 seconds. However it will be apparent that these values can be easily altered by simple modifications to the circuit of FIG. 12, if required.

It should be noted that, although frequency divider 33 has been shown as separate from frequency divider 32 in the timing signal generation circuit of FIG. 12, it is of course possible to make both of frequency dividers 32 and 33 integral parts of a single frequency divider chain.

Figure 14A:
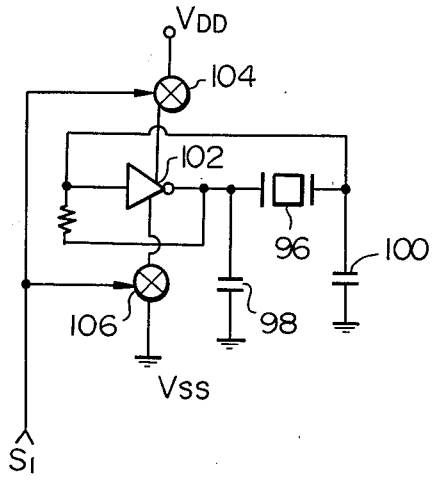
FIG. 14A and FIG. 14B are circuit diagrams of high frequency quartz crystal oscillator circuits suitable for being periodically activated in accordance with the present invention.
Figure 14B:
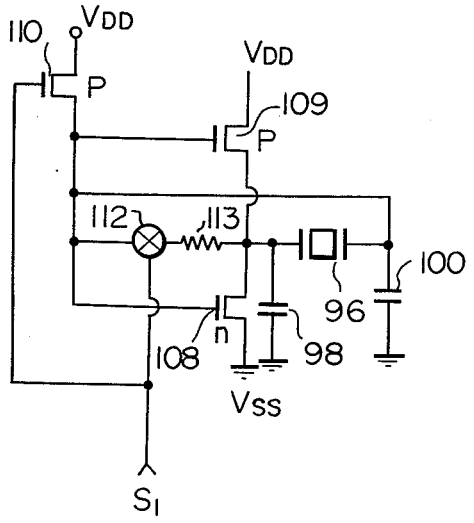

Referring now to FIG. 14A and FIG. 14B, two embodiments of quartz crystal controlled oscillators which are suitable for use as H.F. oscillator circuits with the present invention will be described. In the circuit of FIG. 14A, the frequency of oscillation is controlled by a quartz crystal vibrator 96. This can be, for example, an AT-cut crystal vibrator. A capacitor 98 is connected to the output of an inverter 102 and one electrode of quartz crystal vibrator 96. A cpacitor 100 is connected between the other electrode of quartz crystal vibrator 96 an ground, and to the input of inverter 102. A voltage controlled switch 104 is connected between the power source and a supply terminal of inverter 102, while another voltage controlled switch 106 is connected between a supply terminal of inverter 102 and ground. Both voltage controlled switch 104 and voltage controlled switch 106 are controlled by control signal S1, which has been described hereinabove with respect to the first, second and third embodiments. When control signal S1 is at the L logic level, then power to inverter 102 is cut off, so that production of the H.F. signal is halted, i.e. the H.F. signal is inactivated. When control signal S1 is at the H logic level, power is supplied to inverter 102 through voltage controlled switches 104 and 106.

In the H.F. oscillator circuit embodiment of FIG. 14B, the oscillation frequency is again determined by a quartz crystal vibrator 96 and capacitor 100 and capacitor 98. In this case, an inverter circuit is constituted by P-channel FET 109 and N-channel FET 108, the gate electrode bias voltage of which can be controlled by P-channel FET 110. A voltage-controlled switch 112 is connected between the gates of FETs 108 and 109 and bias resistor 113. Thus, when signal S1, which controls the switch 112, is at the L logic level, switch 112 is inhibited, causing H.F. oscillation to be halted. At this time, FET 110 is made conductive by signal S1, causing FET 108 to be turned to the on (i.e. conductive) state, and FET 109 to be made non-conductive. In this way, any excessive flow of current through FETs 108 and 109 when H.F. oscillation is halted can be prevented. When signal S1 goes to the H logic level, then oscillation becomes enabled, by voltage controlled switch 112.

In order to clearly define the scope of the present invention, which is expressed by the appended claims, a summary of the various features which characterize the present invention will now be given. In the present invention, a high frequency oscillator having a high degree of long-term frequency stability is utilized in conjunction with a relatively low frequency oscillator, for which only a moderate level of frequency stability if required. A plurality of timing signals are produced by a timing signal generating circuit, one of which periodically activates and deactivates the operation of the relatively high frequency oscillator. The duration of each interval in which the relatively high frequency oscillator is activated, referred to in the specification as an oscillation interval, can be for example of the order of 5 to 10 seconds. The period between each successive oscillation interval can be, for example, of the order of half a minute or one minute. In the latter half of an oscillation interval, during a measurement interval, the relatively low and high frequency signals are compared by a phase comparator circuit. The duration of the L.F. signal period is predetermined to differ from an integral number of periods of the H.F. signal by a factor $\alpha$ of less than one. Thus, the H.F. and L.F. signals periodically coincide in phase, and the phase comparator circuit thereby produces a phase comparision signal whose frequency is determined by these periodic coincidences in phase of the L.F. and H.F. signals. In the embodiments described herein, the factor $\alpha$ is positive, since the ratio of the H.F. signal frequency to the L.F. signal frequency is thus slightly greater than N, where N is an integer, then a timebase signal is produced whose frequency is equal to that of the H.F. signal divider by the factor N, when averaged over a certain minimum period of time. This timebase signal is produced by dividing the frequency of the phase comparison signal by the factor N, delaying the resultant frequency-divided signal by a suitable amount, and then aperiodically incrementing the frequency of the L.F. signal by means of the latter frequency-divided signal, which we can refer to as a correction signal. This frequency addition process is illustrated by the waveform diagram of FIG. 4.

During the measurement interval, the number of pulses of the phase comparison signal generated therein is stored as a digital number, in a memory circuit. In the described embodiments, the memory circuit comprises a counter circuit composed of flip-flops. Subsequently, during a period which continues until the next measurement interval occurs, the contents of the memory circuit are periodically read out and used to increment the frequency of the L.F. signal to produce the timebase signal, in the same way as the phase comparison signal was utilized during the preceding measurement interval. It is important to note that, in the described embodiments, the duration of each period in which the memory contents are read out and used to process the L.F. signal, is identical to the duration of a measurement interval. Because of this fact, and because the number of pulses which are read out of the memory each time is identical to the number of phase comparison pulses generated during the preceding measurement interval, it will be apparent that, during the periods between each measurement interval, processing of the L.F. signal to produce the timebase signal is performed in exactly the same way as if the phase comparison signal were used continuously and the frequency of the L.F. signal were absolutely stable during the period between each pair of successive measurement intervals. In fact, since the period between successive measurement intervals is of the order of only half a minute or one minute, for example, any change in the L.F. signal during that time will normally be negligible.

In will therefore be apparent from the above that the present invention enables a timebase signal to be produced by a circuit in which a frequency standard H.F. oscillator is activated for only brief periodic intervals, and that the frequency stability of the timebase signal, and hence of a unit time signal produced from it, is essentially determined by the frequency stability of the H.F. oscillator circuit. Since the H.F. oscillator circuit can utilize a quartz crystal vibrator such as an AT-cut vibrator operating at a frequency of the order of 4 MHz., it will be apparent that the present invention enables a unit time signal of very high frequency stability to be generated. However, since the H.F. oscillator circuit is only activated periodically, with a low duty cycle, and since direct frequency division of the H.F. signal is not performed, it will also be apparent that the present invention further enables a unit time signal of a high degree of frequency stability to be produced without a significant increase in power consumption as compared with a conventional system for producing the unit time signal of an electronic timepiece utilizing a relatively low frequency quartz crystal oscillator circuit to produce a timebase signal. Since no frequency division of the H.F. signal is directly performed, the present invention is applicable without modification to current methods of manufacturing integrated circuits of electronic timepieces, in which only relatively low signal frequencies are handled.

It should be noted that various modifications to the described embodiments are possible, (for example, the delay circuit may consist of various types of device, including a low-pass filter, flip-flop circuit, etc., and may be placed either before or after the 1/N frequency divider) which fall within the scope claimed for the present invention. It is intended that all matter contained in the above description shall be interpreted as illustrative, and not in a limiting sense. The appended claims are intended to cover the generic and specific features of the invention described herein.

What is claimed is:

1. A system for producing a unit time signal of an electronic timepiece, comprising:

a high frequency oscillator circuit for producing a relatively high frequency signal having a high degree of frequency stability;

a low frequency oscillator for producing a relatively low frequency signal, the frequencies of said relatively high frequency signal and said relatively low frequency signal being predetermined such that the duration of one period of said relatively low frequency signal differs by a predetermined factor from the duration of a predetermined integral number of periods of said relatively high frequency signal, the value of said predetermined factor being less than the duration of one period of said relatively high frequency signal;

timing means coupled to said high frequency oscillator, for periodically activating and deactivating the operation of said high frequency oscillator circuit, the duration of each interval of periodic activation of said high frequency oscillator being shorter than the duration of each interval of periodic deactivation;

phase comparator circuit means for comparing the phase of said relatively high frequency signal and said relatively low frequency signal to produce a phase comparison signal comprising a train of pulses, the frequency of said phase comparison signal being identical to the frequency with which the phase of said relatively high frequency signal and the phase of said relatively low frequency signal periodically coincide, said phase comparator circuit means being coupled to said timing means and responsive thereto for producing said phase comparison signal only during a predetermined measurement interval within each of said intervals of periodic activation of said high frequency oscillator circuit;

memory circuit means coupled to receive said phase comparison signal and responsive to said timing means for storing the number of said phase comparison signal pulses occurring during one of said measurement intervals and further responsive to said timing means for producing an output signal comprising a train of pulses equal in number to said stored number of phase comparison pulses during each of a plurality of correction intervals occurring between the termination of one of said measurement intervals and the commencement of a succeeding one of said measurement intervals, the duration of each of said correction intervals being equal to that of each of said measurement intervals;

first frequency divider means coupled to receive said phase comparison signal and said output signal from said memory circuit means, for performing frequency division thereon by a predetermined division value, said predetermined division value being equal to said predetermined integral number of periods of said relatively high frequency signal contained in one period of said relatively low frequency signal, said first frequency divider means thereby producing a correction signal;

frequency processing circuit means for aperiodically modifying the frequency of said relatively low frequency signal in accordance with the frequency of said correction signal, for thereby producing a timebase signal, the frequency of said timebase signal when averaged over a predetermined time period being equal to that of said relatively high frequency signal divided by said division value; and second frequency divider circuit means for dividing the frequency of said timebase signal by a predetermined value to thereby produce a unit time signal.

2. A system for producing a unit time signal according to claim 1, and further comprising selector circuit means coupled to receive said phase comparison signal and said memory circuit output signal, and responsive to said timing means for transferring said phase comparison signal to said first frequency divider circuit during each of said measurement intervals and for transferring said memory circuit output signal to said first frequency divider circuit during each of said correction intervals.

3. A system for producing a unit time signal according to claim 1, in which said predetermined factor whereby said period of the relatively low frequency signal differs from an integral number of periods of said relatively high frequency signal has a positive value.

4. A system for producing a unit time signal according to claim 3, in which said frequency processing circuit means performs aperiodic frequency addition of the frequency of said correction signal to that of said relatively low frequency signal, to thereby produce said timebase signal.

5. A system for producing a unit time signal according to claim 1, in which said timing means comprises timing signal generating circuit means for producing a plurality of timing control signals to be applied to said high frequency oscillator circuit, said phase comparator circuit, and said memory circuit, for controlling the operation thereof.

6. A system for producing a unit time signal according to claim 4, in which said frequency processing circuit means comprises an exclusive-OR logic gate circuit.

7. A system for producing a unit time signal according to claim 4, and further comprising delay circuit means coupled between said selector circuit means and said frequency processing circuit means, in series with said first frequency divider means, to facilitate aperiodic frequency addition by said frequency processing circuit means.

8. A system for producing a unit time signal according to claim 7, in which said delay circuit means comprises a low pass filter circuit.

9. A system for producing a unit time signal according to claim 7, in which said delay circuit means comprises a flip-flop circuit.

10. A system for producing a unit time signal according to claim 1, in which said high frequency oscillator circuit comprises a quartz crystal oscillator circuit operating at a frequency of at least 4 megaherz.

11. A system for producing a unit time signal according to claim 10, in which said quartz crystal oscillator circuit includes an AT-cut quartz crystal vibrator.

12. A system for producing a unit time signal according to claim 1, in which said memory circuit means comprises a plurality of flip-flop circuits.

13. A system for producing a unit time signal according to claim 1, in which said phase comparator circuit means comprises a data type flip-flop, with said relatively high frequency and low frequency signals being coupled to a data terminal and a clock terminal thereof, respectively.

14. A system for producing a unit time signal of an electronic timepiece, comprising in combination:

a high frequency oscillator for producing a relatively high frequency signal having a high degree of frequency stability;

a low frequency oscillator for producing a relatively low frequency signal;

a data-type flip-flop having a data terminal coupled to receive said relatively high frequency signal and a clock terminal coupled to receive said relatively low frequency signal;

a counter circuit comprising a plurality of flip-flop circuits connected in cascade;

a memory circuit comprising a plurality of flip-flop circuits equal in number to said flip-flop circuits of said counter circuit;

a first gate circuit coupled between said counter circuit and said memory circuit for transferring the contents of said counter circuit into said memory circuit in parallel form;

a count comparator circuit coupled to receive outputs of said memory circuit and said counter circuit, for comparing the contents of said memory circuit with those of said counter circuit and for producing a count coincidence signal when coincidence is detected between the contents of said memory circuit and said counter circuit;

a control circuit for memorizing the occurrance of said count coincidence signal, and for subsequently producing a continuous signal indicative thereof;

a first voltage-controlled switch coupled between said data-type flip-flop output and an input of said counter circuit;

a second voltage-controlled switch coupled between said low frequency oscillator output and said input of the counter circuit being controlled by the output of said control circuit such as to be closed when said continuous signal is produced therefrom;

a timing signal generating circuit for producing first, second, third and fourth timing control signals, said first timing control signal being applied to said high frequency oscillator circuit for enabling operation thereof only during periodically repeated oscillation intervals of predetermined duration, said second timing control signal being applied in inverted form to a reset terminal of said data-type flip-flop for enabling the opration thereof, to a reset terminal of said memory circuit for resetting the contents thereof to zero, and to said control circuit for inhibiting the operation thereof, and to said first voltage controlled switch for thereby actuating said first voltage-controlled switch to close, said third timing control signal being applied to said gate circuit for thereby transferring the contents of said counter circuit into said memory circuit, and further being applied to said control circuit for inhibiting the operation thereof, and said fourth timing control signal being applied to a reset terminal of said counter circuit for resetting the contents thereof to zero;

a low pass filter coupled to said input of the counter circuit, to receive signals transferred thereto by said first and second voltage controlled switches;

a first frequency divider circuit coupled to receive said phase comparison signal from an output of said low-pass filter circuit, for dividing the frequency of said phase comparison signal by a predetermined division value;

a frequency processing circuit for aperiodically incrementing the frequency of said relatively low frequency signal by that of the frequency-divided output signal from said first frequency divider circuit to thereby produce a timebase signal; and a second frequency divider for dividing the frequency of said timebase signal from said frequency processing circuit, to thereby produce a unit time signal.

15. A system for producing a unit time signal of an electronic timepiece, comprising in combination:

a high frequency oscillator having a high degree of frequency stability, for producing a relatively high frequency signal;

a low frequency oscillator for producing a relatively low frequency signal;

a data-type flip-flop having a data terminal coupled to receive said relatively high frequency signal and a clock terminal coupled to receive said relatively low frequency signal;

a memory counter circuit comprising a plurality of flip-flop stages connected in cascade, coupled to receive a phase comparison signal comprising a pulse train which is produced periodically by said data-type flip-flop, for counting the number of pulses in each of said phase comparison signal pulse trains and for memorizing the count obtained;

a counter circuit comprising a plurality of flip-flop stages connected in cascade and equal in number to said stages of said memory counter circuit;

a transfer gate circuit coupled to receive an output from each stage of said memory counter circuit;

a count detection gate circuit coupled to each stage of said counter circuit for detecting a maximum count state of said counter circuit, and for producing a detection signal when such a maximum count state occurs;

an input gate circuit coupled between said low frequency oscillator and an input terminal of said counter circuit, and responsive to the output of said count detection gate for being inhibited when said detection signal is produced therefrom;

selector circuit means coupled to receive said relatively low frequency signal from an output of said input gate circuit and to receive a phase comparison signal produced by said data-type flip-flop;

a timing signal generating circuit for producing first, second and third timing control signals, said first timing control signal being applied to said high frequency oscillator circuit for enabling operation thereof only during periodically repeated oscillation intervals of predetermined duration, said second timing control signal being applied in inverted form to a reset terminal of said data-type flip-flop for enabling the operation thereof only during periodically repeated measurement intervals of predetermined duration, and being further applied to said selector circuit means for actuating said selector circuit means to transfer a phase comparison signal produced by said data-type flip-flop to an output terminal thereof during said measurement interval, said selector circuit means coupling the output of said input gate circuit to said output terminal in the absence of said second control signal, said second control signal being applied in to a reset terminal of said memory counter circuit for periodically resetting the contents thereof to zero, and said third timing control signal being coupled to said transfer gate circuit, for actuating said transfer gate circuit to transfer the arithmetic complement of the contents of said memory counter circuit into said counter circuit;

a low-pass filter circuit coupled to said output terminal of said selector circuit means;

a first frequency divider circuit coupled to receive output signals from said low-pass filter circuit for dividing the frequency of said output signals by a predetermined division value;

a frequency processing circuit for aperiodically incrementing the frequency of said relatively low frequency signal by that of the frequency-divided output signal from said first frequency divider circuit to thereby produce a timebase signal; and a second frequency divider for dividing the frequency of said timebase signal from said frequency processing circuit, to thereby produce a unit time signal.

16. A system for producing a unit time signal of an electronic timepiece, comprising in combination:

a high frequency oscillator having a high degree of frequency stability, for producing a relatively high frequency signal;

a low frequency oscillator for producing a relatively low frequency signal;

a data-type flip-flop having a data terminal coupled to receive said relatively high frequency signal and a clock terminal coupled to receive said relatively low frequency signal;

a counter circuit comprising a plurality of flip-flops connected in cascade;

a zero detection flip-flop coupled to a final stage of said counter circuit for detecting a point at which the contents of said counter circuit change from a condition of maximum count to a count of zero and for producing a detection signal indicative of such a change;

an input gate circuit coupled to receive a phase comparison signal generated by said data-type flip-flop;

a first frequency divider for performing frequency division by a predetermined division factor;

a first voltage-controlled switch coupled between an output terminal of said input gate circuit and an input terminal of said counter circuit;

a second voltage-controlled switch coupled between said output terminal of the input gate circuit and an input of said first frequency divider;

an output gate circuit coupled to receive said detection signal from the zero detection flip-flop, and having an output terminal coupled to a control terminal of said first voltage-controlled switch;

a timing signal generator circuit for producing first, second, third, fourth and fifth timing control signals, said first timing control signal being applied to said high frequency oscillator circuit for enabling operation thereof only during periodically repeated oscillation intervals of predetermined duration, said second timing control signal being applied in inverted form to a reset terminal of said data-type flip-flop for enabling the operation thereof only during periodically repeated measurement intervals, said third timing control signal being applied to an input of said output gate circuit for thereby setting said first voltage controlled gate in an open condition when said detection signal is being generated by the zero detection flip-flop, said fourth timing control signal being applied to a reset terminal of said zero detection flip-flop for resetting said detection signal to zero, and said fifth timing control signal being composed of periodically repeated groups of pulses with the number of pulses in each group being dependent on the maximum count value of said counter circuit, said fifth timing control signal being applied to an input terminal of said input gate circuit, and transferred therefrom into said counter circuit and said first frequency divider at times determined by the conditions of said first and second voltage-controlled switches;

delay/synchronization circuit means coupled to receive a frequency-divided output signal from said first frequency divider and said relatively low frequency signal, for first producing a synchronized signal corresponding to said frequency-divided output signal and having logic level transitions synchronized with those of said relatively low frequency signal and subsequently producing a delay in phase of said synchronized signal;

an exclusive-OR logic gate coupled to receive said relatively low frequency signal and an output signal from said delay/synchronization circuit, for thereby producing a timebase signal; and a second frequency divider coupled to receive said timebase signal, for thereby producing a unit time signal.

* * * * *